US005246123A

United States Patent [19]

Kramer et al.

[11] Patent Number: 5,246,123

[45] Date of Patent: Sep. 21, 1993

[54] CONVERSION APPARATUS FOR CHILD-RESISTANT CONTAINER CLOSURE

[76] Inventors: Steven G. Kramer, 60 El Verano Way, San Francisco, Calif. 91427; Arthur Lutz, 7 Walnut Ave., Larkspur, Calif. 94939

[21] Appl. No.: 885,003

[22] Filed: May 19, 1992

Related U.S. Application Data

[63] Continuation of Ser. No. 632,177, Dec. 21, 1990, abandoned.

[51] Int. Cl.[5] ..... B65D 55/02

[52] U.S. Cl. ..... 215/220; 215/219; 215/218

[58] Field of Search ..... 215/220, 221, 352, 256, 215/252, 274, 273, 218, 258, 334, 335, 230, 219; 220/319

[56] References Cited

U.S. PATENT DOCUMENTS

| | | | |
|---|---|---|---|
| 2,854,163 | 9/1958 | Barnby | 215/352 X |
| 3,151,599 | 10/1964 | Livingston . | |
| 3,403,803 | 10/1968 | Markowitz | 215/218 |
| 3,432,065 | 3/1969 | Bugla . | |
| 3,830,390 | 8/1974 | Gach . | |
| 3,857,505 | 12/1974 | Mumford et al. . | |
| 3,888,375 | 6/1975 | Gerk . | |
| 3,989,153 | 11/1976 | McRoskey et al. . | |
| 4,061,239 | 12/1977 | Tasseron | 215/221 |
| 4,220,257 | 9/1980 | Kramer . | |
| 4,365,722 | 12/1982 | Kramer . | |
| 4,433,789 | 2/1984 | Gibilislo | 215/220 |
| 4,493,427 | 1/1985 | Wolkonsky | 215/258 X |
| 4,526,293 | 7/1985 | Kramer . | |
| 4,719,487 | 3/1988 | Wright | 215/220 |
| 4,775,064 | 10/1988 | Baxter | 215/252 X |
| 4,832,218 | 5/1989 | Gibilislo | 215/220 |
| 4,854,459 | 8/1989 | DeJonge | 215/220 |

FOREIGN PATENT DOCUMENTS 1349612 10/1974 United Kingdom .

*Primary Examiner*—Allan N. Shoap
*Assistant Examiner*—Paul A. Schwarz
*Attorney, Agent, or Firm*—Emrich & Dithmar

[57] ABSTRACT

A conversion device for use with a child-resistant container closure of the type including a two-piece housing including a ratchet-type mechanism which is effective to cause the two housing members to turn together as a single unit when the outer housing member is depressed and rotated simultaneously, the conversion device comprising an annular element which is inserted into the open end of the closure and snapped into place to maintain a relative position between the two housing members in which the ratchet mechanism is continuously engaged. The conversion device is mounted on a card member which facilitates assembly of the device with a container closure.

24 Claims, 1 Drawing Sheet

CONVERSION APPARATUS FOR CHILD-RESISTANT CONTAINER CLOSURE

This is a continuation of application Ser. No. 07/632,177, filed Dec. 21, 1990, now abandoned.

BACKGROUND OF THE INVENTION

This invention relates to closure members for containers, bottles, and the like, and more particularly, to closure members which are adapted for use on dispensing containers for medicinal agents.

Child-resistant closures are used widely in the pharmaceutical industry. Closures for threaded, screw-type bottles generally consist of a two piece housing including an inner housing member and an outer housing member. The inner housing member has a threaded inner surface and acts as the actual screw-type closure of the bottle. The outer housing member nests over the inner housing member. The user handles the outer housing member in opening or closing the bottle. A mechanism, typically a ratchet-type system, is disposed between the two housing members to transmit the user's twisting torque from the outer housing member to the inner housing member when the outer housing member is turned in the closing direction, typically clockwise. When the outer housing member is turned in the closing direction, the two housing members turn together as one single unit. When the user turns the outer housing member in an opening direction, typically counterclockwise, the outer housing member slips and rotates by itself without transmitting the user's twisting torque to the inner housing member.

This ratchet-type mechanism is typically disposed so as to require that the user depress downwardly on the outer housing member simultaneously while turning the outer housing member in the opening direction in order to remove the closure. To this end, part of the ratchet mechanism is provided on the inner surface of the outer housing member and located to engage a complementary part of the ratchet mechanism which is provided on the outer surface of the inner housing member in such fashion that the two housing members turn as one single unit.

The act of applying downward pressure to the closure while simultaneously turning it in the opening direction is difficult to understand and accomplish, and most young children cannot do so. Therefore, closures such as those described are commonly referred to as "child-resistant" closures.

A disadvantage of child-resistant closures of the type described above is that they may be difficult to use for certain individuals, rendering it difficult for them to open their medicine bottles. Such individuals include, for example, elderly, infirm, ill or otherwise incapacitated persons. Although at the present time, child-resistant closures are required for containers for prescription medications, the use of such a closure is at the individual's or patient's discretion so that, for example, an elderly patient suffering from arthritis who does not have children will not have to suffer the difficulty or inconvenience of using a closure in an environment in which it is not required.

However, child-resistant closures such as those described above are typically provided on "unit-of-use" containers which are dispensed from pharmacists to patients as shipped from the pharmaceutical manufacturer. Thus, patients have no choice about whether or not to use the child-resistant closure, and frequently patients without children may close their containers loosely or not at all, practices which are likely to lead to chemical deterioration or instability of the contained medication.

SUMMARY OF THE INVENTION

It is an object of the invention to provide a conversion apparatus for use with a child-resistant container closure for converting the closure to a non-child-resistant container closure at the discretion of an adult user.

A further object of the invention is to provide a conversion apparatus for converting a child-resistant container closure to a non-child-resistant container closure, which conversion apparatus is easy to use and inexpensive to manufacture.

These and other objects are achieved by the present invention which has provided a conversion apparatus for use with a child-resistant container closure of the type including an inner housing member and an outer housing member which is adapted to nest and rotate about the inner housing member, the container closure including a coupling mechanism disposed between the two housing members to couple the housing members together whereby twisting torque applied to the outer housing member is transferred to the inner housing member, the coupling mechanism being effective only for a given relative position between the housing members, the conversion apparatus comprising a conversion device for causing the outer housing member to be continuously coupled to the inner housing member whereby the inner housing member always rotates together with the outer housing member upon rotation of the outer housing member in either direction.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF A PREFERRED EMBODIMENT

Figure 1:
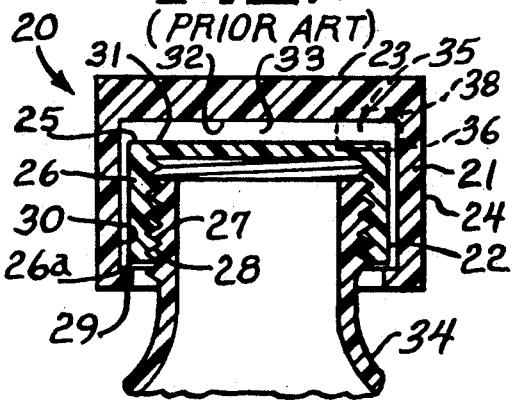
FIG. 1 (PRIOR ART)
FIG. 1, which is labelled "PRIOR ART", is a side sectional view of a known two-piece child-resistant container closure, illustrated mounted on a container.

Referring to FIG. 1 of the drawings, there is illustrated a known child-resistant container closure 20 of the type including two nested housing members, an outer housing member 21 and an inner housing member 22. The outer housing member 21 has a circular planar top 23 and a cylindrical side wall or skirt 24 formed integrally therewith. Similarly, inner housing member 22 has a circular planar top 25 and a cylindrical side wall or skirt 26 formed integrally therewith. The inner housing member has threads 27 formed on the inner surface 28 of its side wall 26 to mount on a container the neck portion 34 of which is shown in FIG. 1. The outer housing member 21 has an inwardly directed flange 29 on the lower, inner surface 30 of its side wall 24 which maintains the two housing members in permanent nested relationship with each other while enabling relative axial movement therebetween. The bottom edge 26*a* of the inner housing member sidewall 26 is disposed adjacent to, or in engagement with the upper surface of the flange 29 for the relative positioning of the housing members illustrated in FIG. 1, which is the "at-rest" position for the closure. The "at-rest" position for the closure is created by a coupling mechanism that will be described subsequently. In such position, the upper or outer surface 31 of the top portion 25 of the inner housing member 21 is spaced from the lower or inner surface 32 of the outer member 21 defining a space 33 between the two housing members. In such space complementary elements 35 and 36 of a coupling or interengaging mechanism are located in the general area 38 indicated by the dotted rectangle on the drawing. With downward axial movement of the outer housing member 21 relative to the inner housing member 22 to the relative positioning illustrated in FIG. 2, which is the "operated" position, top portion 23 is moved toward top portion 25 and flange 29 is moved away from bottom edge 26*a*, increasing the space 39 therebetween.

The coupling mechanism, typically a ratchet-type system, is disposed between the two housing members to transmit the user's twisting torque from the outer housing member 21 to the inner housing member 22 when the outer housing member is turned in the closing direction, typically clockwise. When the outer housing member is turned in the closing direction, the two housing members turn together as one single unit. When the user turns the outer housing member in an opening direction, typically counterclockwise, the outer housing member slips and rotates by itself without transmitting the user's twisting torque to the inner housing member. This ratchet-type mechanism is disposed so as to require that the user depress downwardly on the outer housing member simultaneously while turning or rotating the outer housing member in the opening direction in order to remove the closure. To this end, part of the ratchet mechanism is provided on the inner surface of the outer housing member and located to engage a complementary part of the ratchet mechanism provided on the outer surface of the inner housing member.

Figure 2:
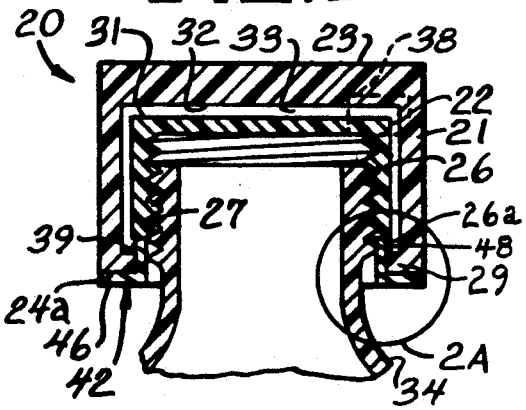
FIG. 2 is a side sectional view of the child-resistant container closure of FIG. 1 together with a conversion device provided by the present invention for converting the container closure to a non-child-resistant closure.
Figure 3A:
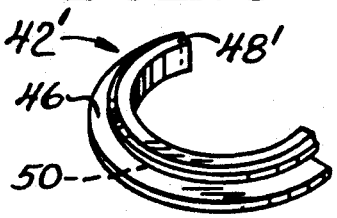
FIG. 3A is a perspective view of a further embodiment for the conversion device of the present invention.
Figure 3:
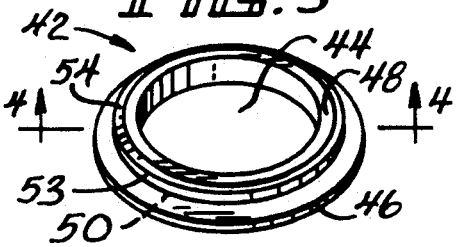
FIG. 3 is a perspective view of the conversion device of the present invention.
Figure 4:
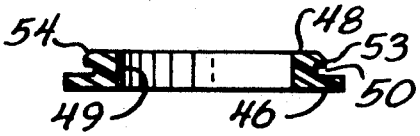
FIG. 4 is a sectional view of the conversion device taken along line 4—4 of FIG. 3.

Referring to FIGS. 2–4, in accordance with the present invention, there is provided a conversion apparatus comprising a conversion device 42 which is adapted for assembly with a child-proof container closure to interlock the outer and inner housing members so that they operate as a single unit. The conversion device 42 is disclosed as comprising an annular ring-shaped element which is adapted to be received into the annular space 39 to prevent relative axial movement between the two housing members to thereby maintain the coupling mechanism continuously engaged, converting the container closure 20 from a child-resistant closure to a non-child-resistant closure. However, other types of conversion devices may be used, such as devices which interconnect the two housings or devices in the form of a segment or portion of an arcuate ring, such as device 42′ illustrated in FIG. 3A which comprises a section of a ring-shaped element and has a cam portion 48′ which is a section of a generally annularly-shaped element or one or many elements, which may be interconnected or not, which function as cams or wedges but which are assembled with a child-proof container closure in a different manner than device 42 as disclosed herein, but which function to maintain the coupling mechanism engaged.

Figure 5:
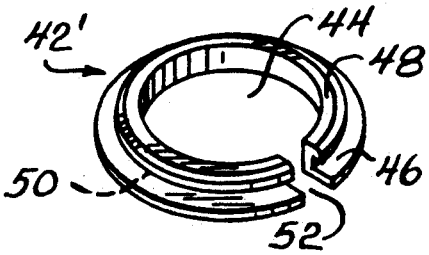
FIG. 5 is a perspective view of a further embodiment for a conversion device provided by the present invention.

The conversion device 42 comprises a ring-shaped element having a central aperture 44 with a lower radial flange or a annular securing portion 46 and an upper radial flange or cam portion 48 spaced apart from the lower flange 46 by a vertical wall portion 49 of reduced diameter defining an annular groove or groove 50 around the edge of the element. The element 42 is formed of a suitable rigid material, such as DELRIN, but which is characterized by a limited amount of flexibility to permit the element 42 to be "snapped" into place in use. Referring to FIG. 5, there is illustrated a further embodiment for a conversion device 42′ which is discontinuous defining a gap 52 which permits the device to flex radially inwardly and outwardly so as to adapt to container closures of different sizes within a given range.

Referring to FIGS. 2–4, the diameter of the aperture 44 is slightly greater than the inner diameter of the threaded inner surface 28 of the inner housing member 22. The outer diameter of lower flange 46 of the element 42 is approximately equal to the outer diameter of the outer housing member 21. The outer diameter of the upper flange 48 is less than the inner diameter of the outer housing member 21. The vertical spacing between the two flanges 46 and 48, which defines the vertical length of the wall portion 49 and of the groove 50, is slightly greater than the thickness of the flange 29. The depth of the groove 50 radially substantially corresponds to the radial length of the flange 29. The outer edge 53 of the upper flange 48 is beveled as indicated at 54, to facilitate its entry into the space 39 between the flange 29 of the outer housing 21 and the inner housing bottom edge 26*a*.

Figure 2A:
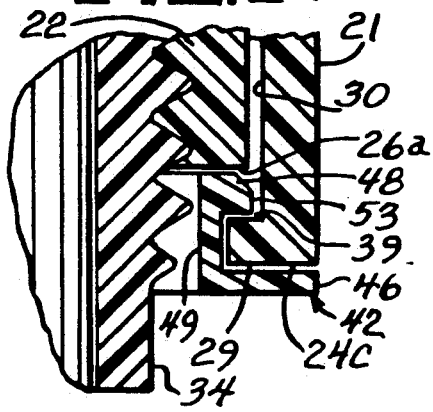
FIG. 2A is an enlarged fragmentary view of the portion of the conversion device and the container closure within the circle in FIG. 2, illustrating the relationship between the conversion device and the container closure.

In use, to convert the container closure 20 from a child-resistant closure as illustrated in FIG. 1, to a non-child-resistant closure, the conversion device 42 is mounted on the bottom portion of the closure 20 as illustrated in FIG. 2. Referring to FIGS. 2 and 2A, the flange 29 of the outer housing member 21 is received in the groove 50 of the conversion device 42, and the upper flange 48 of the conversion device 42 is located in the space 39 between flange 29 and the bottom edge 26*a* of the inner housing member 22. Accordingly, the conversion device 42 acts as a wedge with upper flange 48 urging the inner housing member 22 upwardly to engage the coupling mechanism 38 provided at the upper or top portion 25 of the inner housing member 22 so that at this relative positioning of the housing members, the coupling mechanism is maintained continuously engaged. As shown in FIGS. 2 and 2A, the lower flange 46 extends along the bottom edge 24a of the outer housing member and cooperates with the upper flange 48 to secure the device 42 to the closure 20. The diameter of aperture 44 is sufficiently large to enable the threaded neck portion 34 of the container to pass therethrough.

When the conversion device 42 is pressed into the opening defined by the lower edge of the outer housing member, the upper flange 48 engages the lower edge 26a of the inner housing 22, forcing the inner housing member 22 upwardly into the cavity of the outer housing member 21. The conversion device 42 remains "snapped" into this position because the flange 29 on the lower edge of the outer housing becomes located in the groove 50 between the two flanges 46 and 48 on the conversion device 42. As indicated above, the conversion device 42' may be a split or discontinuous ring or section thereof defining gap 52, to enhance its flexibility rendering insertion and removal of the device easier for the user.

Referring to FIGS. 2 and 3, by way of example of the manner of assembling the device 42 with an existing container closure 20, first the user orients the conversion device 42 with its wider flange 46 on the bottom and its narrower flange 48 at the top. Then the user places the container closure 20 over the conversion device with the flange 29 at the lower edge of the closure resting on the upper radial flange 48 of the conversion device. The user then pushes the closure downwardly whereby the flange 29 rides along the bevelled edge 54 of the upper flange 48, causing the device to flex about its thin walled portion 49 driving the upper flange inwardly toward the neck of the container. With continued downward movement of the closure, the inner edge of flange 29 moves past the outer edge 53 of the upper flange 48, permitting the device 42 to restore under the force of its resilience. As the upper flange 48 returns to its rest position, it engages the bottom edge of the inner housing member 22, wedging itself in between the bottom edge of the inner housing member and the upper surface of the flange 29 of the outer housing member.

Figure 6:
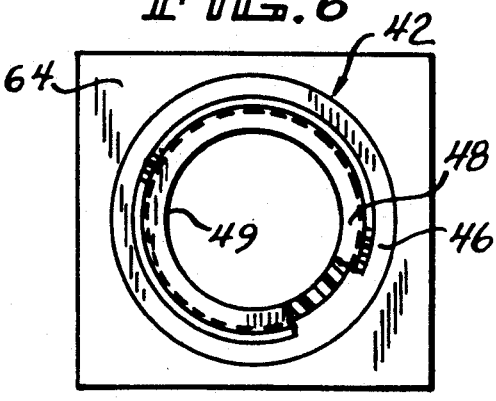
FIG. 6 is a top plan view of the conversion device, partially broken away, and illustrated mounted on an instruction card prior to use.

Referring to FIG. 6, in accordance with another aspect of the invention, on the conversion device 42 is mounted on an instruction card 64 by which the device 42 is packaged for retail sale. The conversion device 42 is secured to the card in a suitable manner, such as by an adhesive which is temporarily maintains the conversion device 42 on the card 64 but which permits the device 42 to be removed from the card when desired. The card 64 may contain suitable instructions for use and installation of the device.

The mounting of the conversion device 42 on the instruction card greatly simplifies its assembly with a child-proof type container closure because the instruction card when laid flat on a table or other level surface orients the conversion device so that all the user need do is place the closure bottom side down on the device and press the closure onto the card. When the device snaps into the closure and the conversion device is pulled from the card, the closure is ready for use as a non-child-proof closure.

The conversion device 42, by virtue of its upper flange 48 being located in the space 39, functions as a cam or wedge to maintain the two housing members 21 and 22 in the "operated" position with the coupling mechanism engaged. That is, the conversion device 42 when assembled with the two housing members maintains a given relative positioning between the housing members whereby the interengaging means continuously couples the outer housing member 21 to the inner housing member 22. Thus, when the outer housing member 21 is rotated, the two housing members 21 and 22 will turn together as a single unit.

We claim:

1. In a child-resistant container closure of the type including an inner housing member and an outer housing member which is adapted to nest and rotate about the inner housing member, the outer housing member being movable relative to the inner housing member of the closure and the outer housing member defining an inwardly directed flange for maintaining the housing members in permanent nested relationship with each other, the inner housing member having a bottom edge which overlies the flange, the container closure including a coupling mechanism disposed between the housing members to couple the housing members together, the coupling mechanism being effective only for a given relative position between the housing members, the improvement comprising: a conversion device having a cam portion and an annular securing portion which cooperates with said cam portion when said conversion device is assembled with the container closure for securing said device to the inwardly directed flange of the outer housing member and locating said cam portion between the bottom edge of the inner housing member and the flange of the outer housing member in engaging relationship with said bottom edge and said flange for enabling said cam portion to wedge apart the inner and outer housing members to thereby maintain said given relative position between the housing members for which the coupling mechanism is continuously effective so that twisting torque applied to the outer housing member is transferred to the inner housing member.

2. A container closure according to claim 1, wherein said conversion device comprises a section of a ring-shaped element.

3. A container closure according to claim 1, wherein said cam portion is generally annular in shape.

4. A container closure according to claim 1, wherein said cam portion is a section of a generally annularly-shaped element.

5. A container closure according to claim 3, wherein said annular securing portion of said conversion device extends in a parallel spaced relationship relative to said cam portion, defining an annular gap therebetween for receiving the flange of the outer housing member.

6. A container closure according to claim 1, wherein said conversion device comprises a generally annular first flange portion defining said cam portion, said flange portion of said conversion device and said annular securing portion extending in a parallel spaced relationship therewith, defining a gap therebetween for receiving the flange of the outer housing member.

7. A container closure according to claim 6, wherein said conversion device is discontinuous, defining first and second ends which are movable toward and away from one another.

8. A container closure according to claim 2, wherein said conversion device section defines first and second ends which are movable toward and away from one another.

9. A container closure according to claim 1 wherein said conversion device comprises a ring-shaped element.

10. In a child-resistant container closure including an inner housing member having a top portion to cover a mouth of a container and an annular side wall depending therefrom, defining means for removably securing the closure to the container, and an outer housing member having a top portion and an annular side wall depending therefrom, the outer housing member being adapted to nest and rotate about the inner housing member and being movable axially relative to the inner housing member of the closure between first and second positions, the annular side wall of the outer housing member defining an inwardly directed flange near a bottom edge thereof for maintaining the housing members in permanent nested relationship with each other, the bottom edge of the inner housing ember being spaced apart from the inwardly directed flange defining an annular channel for a given relative position between the housing members, the housing members defining interengaging means constructed and arranged to couple the outer housing member to the inner housing member when the housing members are in said given relative position, the improvement comprising: a conversion device adapted for assembly with the container closure in engaging relationship with at least one of the housing members for maintaining the housing members in said given relative position wherein the interengaging means continuously couples the outer housing member to the inner housing member, said conversion device having wedging means and securing means which is generally annular in shape and cooperates with said wedging means when said conversion device is assembled with the container closure for securing the conversion device to the inwardly directed flange of the outer housing member and locating said wedging means in the annular channel defined by the flange of the outer housing member and the bottom edge of the inner housing member for enabling said wedging means to hold apart the inner and outer housing members to thereby maintain said given relative position between said housing members so that twisting torque applied to the outer housing member is transferred to the inner housing member.

11. A container closure according to claim 10, wherein said wedging means is generally annular in shape.

12. A container closure according to claim 10, wherein said wedging means is a section of a generally annularly-shaped element.

13. A container closure according to claim 11, wherein said securing means extends in a parallel spaced relationship relative to said wedging means defining an annular gap therebetween for receiving the flange of the outer housing member.

14. A container closure according to claim 12, wherein said securing means comprises a section of a generally annular shaped element and extends in a parallel spaced relationship relative to said wedging means defining an annular gap therebetween for receiving the flange of the outer housing member.

15. A container closure according to claim 10, wherein said conversion device comprises a generally annular element having a first flange portion defining said wedging means and a second flange portion defining said securing means, said flange portions of said conversion device extending in a parallel spaced relationship defining a gap therebetween or receiving the flange of the outer housing member.

16. A container closure according to claim 15, wherein said conversion device is discontinuous, defining first and second ends, which are movable toward and away from one another.

17. A container closure according to claim 10, wherein said conversion device comprises a section of a generally annular element having a first flange portion defining said wedging means and a second flange portion defining said securing means, said flange portions of said conversion device extending in a parallel spaced relationship defining a gap therebetween for receiving the flange of the outer housing member.

18. In a child-resistant container closure including an inner housing member having a top portion to cover a mouth of a container and an annular side wall depending therefrom, defining means for removably securing the closure to the container, and an outer housing member having a top portion and an annular side wall depending therefrom, the outer housing member being adapted to nest and rotate about the inner housing member and being movable axially relative to the inner housing member thereof between first and second positions, the annular side wall of the outer housing member defining an inwardly directed flange near a bottom edge thereof for maintaining the housing members in permanent nested relationship with each other, the bottom edge of the inner housing ember being spaced apart from the flange defining an annular channel for a given relative position between the housing members, the housing members defining interengaging means constructed and arranged to couple the outer housing member to the inner housing member when the housing members are in said given relative position, the improvement comprising: a conversion device having wedging means and securing means, said securing means being generally annular in shape and cooperating with said wedging means when said conversion device is assembled with said container closure for securing the conversion device to the inwardly directed flange of the outer housing member and locating said wedging means in the annular channel defined by the housing members for enabling said wedging means to hold apart the inner and outer housing members to thereby maintain said given relative position between the housing members wherein the interengaging means continuously couples the outer housing member to the inner housing member so that twisting torque applied to the outer housing member is transferred to the inner housing member.

19. A container closure according to claim 18, wherein said wedging means comprises a ring-shaped element.

20. A container closure according to claim 19, wherein said conversion device comprises a split ring.

21. A container closure according to claim 18, wherein said wedging means comprises a section of a ring-shaped element.

22. A container closure according to claim 18, wherein said wedging means has a generally flat upper surface, the upper peripheral edge of which is beveled.

23. A container closure according to claim 18, wherein said securing means is generally annular in shape, and said wedging means has a second annular portion extending in a parallel spaced relationship with said securing means defining a gap therebetween for receiving the inwardly directed flange of the outer housing member.

24. A container closure according to claim 23, wherein the depth of said gap corresponds to the radial length of the flange of the outer housing member.

* * * * *

UNITED STATES PATENT AND TRADEMARK OFFICE

CERTIFICATE OF CORRECTION

PATENT NO. : 5,246,123
DATED : September 21, 1993
INVENTOR(S) : Steven G. Kramer and Arthur Lutz It is certified that error appears in the above-indentified patent and that said Letters Patent is hereby corrected as shown below:

| COLUMN | LINE | |
|---|---|---|
| 7 | 20 | Delete "ember" and insert --member-- |
| 8 | 1 | Delete "or" and insert --for-- |
| 8 | 29 | Delete "ember" and insert --member-- |

Signed and Sealed this

Twenty-ninth Day of March, 1994

Bruce Lehman

*Attest:*

BRUCE LEHMAN

*Attesting Officer*

*Commissioner of Patents and Trademarks*